United States Patent [19]

Walker

[11] Patent Number: 4,852,669

[45] Date of Patent: Aug. 1, 1989

[54] DIRECTIONAL DOWNHOLE DRILL APPARATUS

[76] Inventor: Thomas A. Walker, R.D. #1, Box 160, Berlin, Pa. 15330

[21] Appl. No.: 191,374

[22] Filed: May 9, 1988

[51] Int. Cl.[4] ..... F21B 17/00

[52] U.S. Cl. ..... 175/73; 175/107; 175/296

[58] Field of Search ..... 175/19, 73, 75, 97, 175/102, 106, 107, 296, 415, 417; 173/17, 137

[56] References Cited

U.S. PATENT DOCUMENTS

| | | | |
|---|---|---|---|
| 2,641,445 | 6/1953 | Snyder . | |
| 2,942,851 | 6/1960 | Beck . | |
| 2,979,033 | 4/1961 | Bassinger . | |
| 3,045,768 | 7/1962 | Huffman . | |
| 3,077,937 | 2/1963 | Tiraspolsky et al. | 175/107 |
| 3,517,754 | 6/1970 | Hughes . | |
| 3,934,660 | 1/1976 | Nelson | 175/102 |
| 4,019,591 | 4/1977 | Fox | 175/107 |
| 4,019,592 | 4/1977 | Fox | 175/234 |
| 4,049,066 | 9/1977 | Richey | 175/323 |
| 4,084,646 | 4/1978 | Kurt | 173/17 |
| 4,278,136 | 7/1981 | Hansson | 175/99 X |

*Primary Examiner*—William P. Neuder

*Attorney, Agent, or Firm*—Buchanan Ingersoll; Paul A. Beck

[57] ABSTRACT

An apparatus is provided whereby a standard percussive-type downhole drill may be utilized in directional drilling. This eliminates the need for less efficient tricone type downhole motors in this application. A motor is provided directly on top of the hammer at the end of the drill string, which both rotates the hammer and allows the passage of compressed air to the hammer for its piston operation. A preferred embodiment of the motor is an air-driven turbine with a replaceable connecting subassembly to link the motor shaft to the hammer apparatus.

6 Claims, 1 Drawing Sheet

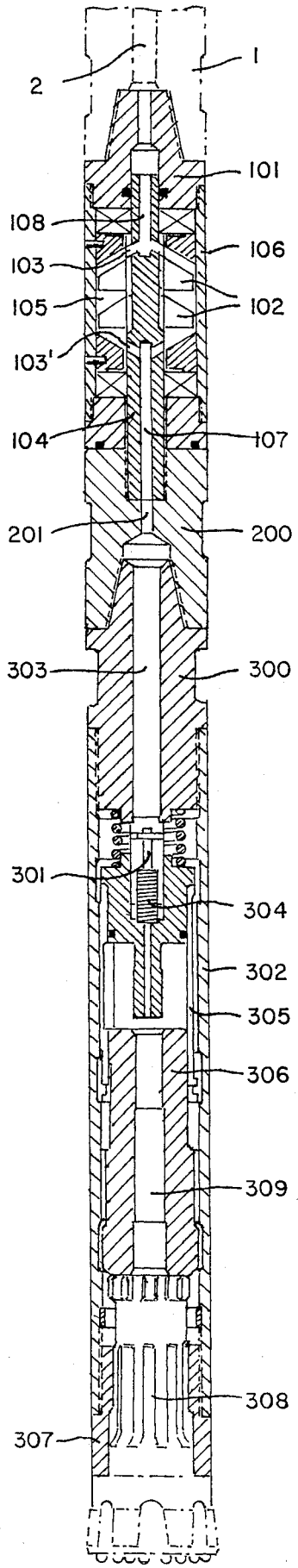
2
1
101
108
106
103
105
102
103'
104
107
201
200
303
300
301
304
302
305
306
309
308
307

DIRECTIONAL DOWNHOLE DRILL APPARATUS

BACKGROUND OF THE INVENTION

1. Field of the Invention

The present invention relates to an air driven motor adapted for use with a downhole drill hammer, and more particularly to a motor which allows such a hammer to be used for directional drilling.

2. Description of the Prior Art

Directional drilling is a technique whereby a bore is cut into the earth at some angle away from the vertical. The use of this technique is warranted by both economics and physical impossibilities in attempting to reach a target some distance below the surface of the earth. Oil, gas and other natural resources are not always conveniently located so that a drill can be erected immediately above a reserve and cut straight down into it. Most often, directional drilling is utilized to avoid surface irregularities, such as river beds or mountains; to secure the most advantageous angle of attack when passing through a fault zone; avoiding salt dome deposits above the target; and to allow several bores to be drilled from a single location to minimize expense.

In all applications, the bore is begun in a vertical direction, normal to the surface of the earth. At some predetermined time, the angle of the bore is changed and directional drilling begins. This is carefully planned to select the optimum location for the initial vertical bore, and the depth at which the change in angle begins. Also planned is the degree of change and the rate of change in angle. A change in angle that is too rapid will not have the accuracy of a long slow curve towards the target. These parameters are based on surface conditions and changes in the rock structure between the surface and the target.

The problem as presented to the inventor is generally one of accuracy and penetration rate, especially in deviated and faulted rock formations and hard rock. Examples of hard rock are limestone, sandstone, granite, and metamorphic and igneous rock in general. The term hard rock is used to describe structures having a compressive strength generally greater than 20,000 psi. Once the directional drilling begins, the bore must be carefully monitored to determine the angle of attack. The crucial parameters are force on the bit and the rotational speed of the drill bit. Higher force and faster speed allow for faster drilling, but accuracy suffers accordingly if drilling is done utilizing conventional techniques. Consequently, the expense of directional drilling is much higher in terms of time per distance drilled than vertical drilling.

The primary problem with the current directional drilling techniques is the available equipment. Although, there are many different types of drill motors and bits currently being used for a wide range of drilling needs, two types of drills are generally used and are of particular interest in downhole drilling. One type, called a valveless downhole drill or drill hammer, is exemplified by Ingersol Rand's DHD-380. This drill hammer is currently used exclusively in vertical drilling. The state of the art does not permit the use of this drill in directional drilling for reasons explained later. Its advantages in downhole vertical drilling are its simple valveless design which requires less maintenance, and its higher power and faster drilling ability. It drills by utilizing both a percussive impact on the rock and a rotary twisting motion. The percussive impact is produced in an oscillating piston-like manner, driven by compressed air from the surface, while the entire hammer body is rotated on a rotational drill pipe or string to produce a rotary motion at the bit. It is this rotary motion which prevents the drill from being used in directional drilling, since the drill string cannot rotate once a non-vertical bore is begun.

The second type of drill discussed here is the downhole motor utilizing the "tri-cone" bit. This model is exemplified by the Norton Christiensen Navi-Drill Mach 1. This type of drill is currently the only model which can be utilized in directional downhole drilling. It can also be utilized in vertical drilling. The motor operates by forcing a liquid mud mixture down the drill pipe which turns a rotor or stator inside the drill casing. This rotor in turn rotates the three cone-shaped bits at the tip of the drill motor. The liquid also serves to cool and lubricate the rotor apparatus. This tool does not have the same power or speed in drilling hard rock as the hammer-type drill, and also requires more maintenance in the form of bit changes and overheating wear in high force drilling applications.

At the same time, the use of mud or slurry to drive a drilling apparatus is inefficient when compared to the use of compressed air, due to increased maintenance required, labor times, and cost. Increased force on the bit or higher pressures of fluid movement increase the efficiency of the motor and bit themselves, but at the same time increase deterioration of both components. Increased wear and deterioration also causes more maintenance time and less time actually drilling. Air cannot be efficiently utilized in the current downhole drill motors used in directional drilling, because the air does not have the force necessary to turn the bit at an efficient speed, nor does it have the cooling ability of the liquid mud and slurry.

The use of the hammer type drill alleviates many of these problems. The use of mud as a drive means is abandoned, and the efficiency of the drill allows for less drilling time to penetrate a similar distance than with a tri-cone drill. This results in less maintenance time as well as less deterioration of the equipment.

The main reason for the use of the hammer when drilling in a deviated or faulted formation, however, is the increased trajectory accuracy and penetration rate. The hammer requires much less force from the drill string compared to a tri-cone drill cutting at the same speed in distance per unit time. Similarly, the rotational speed of the bit is much less for the impact-type hammer. These two parameters are the key to accurate drilling. By reducing the force and speed of the drill, a trajectory may be more carefully traced to the target, while quickly attaining the goal utilizing the hammer drill.

SUMMARY OF THE INVENTION

It is my intention to produce a device which allows the first utilization of the more efficient and powerful downhole percussive hammer device in downhole directional drilling. This is accomplished by placing an air driven motor directly above the hammer on a non-rotational drill string. This is connected to an external air source, which in one embodiment may be fed to the motor and drill hammer through an air passage within the drill string. The use of mud and slurry, which increase the expense of drilling, is eliminated, while retaining a standard derrick and drill string apparatus.

The motor translates the compressed air into rotational motion of a shaft which then supplies the rotational motion to the drill hammer. In this way, the motor may be held stationary, while the hammer rotates about a central axis. This is accomplished in one embodiment by the use of a partially hollow turbine shaft within a sealed motor housing. The shaft has an air passage located within it, and passages to allow air flow between the shaft and the interior of the housing. The air drives the turbine, and is also conserved for use in the drill hammer by being collected at the bottom of the chamber and passed into the hammer body, which is attached to the lower end of the motor. The two devices are attached by a relatively simple and inexpensive collar which both connects the drive means and air supply, and is easily replaceable if damaged.

This method allows the downhole drill hammer to engage the shaft for rotation and for its air supply. The hammer operates when the compressed air drives the motor and rotates the shaft, while the air passing through the motor produces the standard percussive action of the hammer. Thus, both percussive and rotational force is translated to the bit located on the end of the hammer. Until now, utilization of a single power source to produce both of these forces was unknown in directional drilling.

The use of the percussive hammer in a downhole directional drilling operation has several other advantages. Since less force is required to utilize the hammer over the tri-cone bit, fewer "drill collars" are needed on the drill string. Drill collars are heavy sections of drill pipe utilized to increase the weight, and therefore the force, of the drill string. The use of fewer heavy drill collars means that a longer string can be used, since the only limitation is the total weight of the pipe. Fewer heavy collars also reduces manual work load and labor time. Additionally, lighter pipe is easier to move and can be assembled and disassembled faster.

Finally, increased drilling performance, measured in penetration time and ability to penetrate hard rock, of the percussive hammer-type drill will allow drilling in heretofore inaccessible target sites. One example is the west coast of the continental United States, where several oil reserves lie immediately beyond the beach area. Due to high land value and the environmental impact of drilling in a crowded or public area, drilling for these reserves would have to start far back onto the land. Present technology does not allow this length of drill string with sufficient force to penetrate the rock formation. The present invention will easily handle this type of problem.

A second example is drilling in a highly fractured formation. The use of high weight in such an area (to increase force and penetration rate) creates large deviations in the direction of the drill string. This increased inaccuracy makes drilling more of a trial and error process, and increases expenses as well as adversely affecting the environment. The use of the present invention, with its lower force and weight requirements, allows more accurate drilling in this type of formation.

These and other advantages and features of the present invention will be more fully understood on reference to the presently preferred embodiments thereof and to the appended drawing.

DESCRIPTION OF THE FIGURE

The figure shows a front sectional view of the apparatus mounted on a downhole drill hammer.

DESCRIPTION OF THE PREFERRED EMBODIMENTS

Referring to the figure, there are three main sections to the apparatus: the drill string, the motor section, and the hammer section.

A. Non-rotational Drill String

A drill string 1 is comprised of pipe attached to a derrick or other driving device above the surface of the earth. For vertical drilling, this string is straight, however in directional drilling, a bent subassembly, or "bent sub" is utilized to force a curve into the path of the drill motor. One embodiment, as shown, places an internal air passage 2 in the center of the string, but external supply lines (not shown) may also be used.

B. Motor Means

The preferred embodiment of the motor means has a rotor subassembly 101 for engaging the standard sized string termination subassembly. The rotor subassembly has an air intake 108 which allows air from an external source to pass through the rotatable turbine shaft 104 via air passages 103 to the turbine chamber 5. The turbine shaft is shown having vanes 102. Air passages 103' allow the recovery of air to the turbine air exhaust 107. A housing 106 surrounds the mechanism.

C. Means for Engaging the Motor Means to a Drill Hammer

The turbine shaft 104 is threaded into a subassembly 200 which then rotates along with the turbine shaft. The subassembly 200 has an air passage 201 which connects the turbine lower central air passage 107 to the drill hammer 500.

D. The Drill Hammer

The drill hammer is wholly embodied in the commercially available Ingersoll-Rand DHD-380. A detailed description of its various features is located in several Ingersoll-Rand publications, which are hereby incorporated by reference. Drill hammer 500 has a backhead 300 which is threaded into the connecting subassembly 200 and rotates along with the subassembly 200 and the turbine shaft 104. The hammer 500 contains a water check valve 301 which prevents water from fouling the interior air passages of the hammer. The air passes from an external source down passage 303 to the air distributor system 304. This channels the air above and below the piston 306 to force its movement in the cylinder 305. The piston then drives the bit 308 seated in the chuck 307. An exhaust port 309 allows for the emission of the air. The entire device is surrounded by a replaceable wear sleeve 302 for protection of the internal parts.

THE OPERATION

The compressed air is produced at the surface of the drilling site and is passed down the drill string 2, either internally or externally. In the present preferred embodiment, it passes through internal air passage 2 in the drill string 1. The air passes through passages 100 and 103 to chamber 105 and from there to passages 103' and 107. The flow through the chamber rotates the vanes 102 of the turbine shaft 104, causing the shaft to rotate the connecting subassembly 200 and hammer 500.

The compressed air then passes through the connecting subassembly air passage 201 into the hammer air passage 303. The air passes through the water check valve 301 and into the air distributor 304. When the pressure is sufficient, the piston 306 is forced down to the bottom of the cylinder 305, opening ports (not shown) which channel air through the air distributor 304 to the cylinder 305 under the piston 306. When the pressure is sufficient, the piston 306 is then forced up to the top of the cylinder, which then opens ports to channel the air to the area above the piston 306. In this fashion, the piston is continually forced up and down, causing percussive force by the bit 308 to be exerted on the rock face.

Thus, the bit exerts both a percussive and rotary force on the rock face, necessary for the proper and efficient use of the hammer, while additionally enabling it to be used in a non-vertical application.

While I have described a present preferred embodiment of the invention, it is to be distinctly understood that the invention is not limited thereto but may be otherwise embodied and practiced within the scope of the following claims.

I claim:

1. An air-driven directional downhole drilling apparatus, adapted to allow a non-vertical drilling angle, comprising:

(a) a non-rotational drill string having a lower end;
(b) an external air source;
(c) directional means engaging the lower end of the drill string for changing the drilling angle;
(d) motor means engaging the directional means, the motor means having:
(i) a rotatable shaft;
(ii) an air intake; and
(iii) an air exhaust;
wherein the motor means translates compressed air from the external air source into rotational motion of the shaft;
(e) means coupling the external air source to the motor means air intake;
(f) an externally rotated downhole drill hammer;
(g) means engaging the shaft to the downhole drill hammer;
(h) means engaging the motor means air exhaust to the downhole drill hammer, to produce a percussive force on a rock face;

wherein the compressed air rotates the shaft and operates the hammer to produce both rotational and percussive force to a bit located on said hammer.

2. A drill apparatus as claimed in claim 1, wherein said motor means comprises a turbine shaft within a motor housing, having an air passage located within said shaft engaging the drill string air passage, said shaft further comprising passages to allow air flow between the shaft and the interior of the housing.

3. A drill apparatus as claimed in claim 1, wherein the motor is stationary, and the hammer rotates about a central axis.

4. A drill apparatus as claimed in claim 1, wherein the external air source is fed to the motor means and drill hammer through an air passage within the non-rotational drill string.

5. A drill apparatus as claimed in claim 1, wherein the directional means is a bent subassembly.

6. An air-driven directional downhole drilling apparatus, adapted to allow a non-vertical drilling angle, comprising:

(a) a non-rotational drill string having a lower end;
(b) an external air source;
(c) directional means engaging the lower end of the drill string for changing the drilling angle;
(d) turbine driven motor means engaging the directional means, the motor means having:
(i) a rotatable shaft having turbine vanes thereon;
(ii) an air intake; and
(iii) an air exhaust; wherein compressed air from the external air source impinges upon the turbine vanes, producing rotational motion of the shaft;
(e) means coupling the external air source to the motor means air intake;
(f) an externally rotated downhole drill hammer;
(g) means engaging the shaft to the downhole drill hammer;
(h) means engaging the motor means air exhaust to the downhole drill hammer, to produce a percussive force on a rock face;

wherein the compressed air rotates the shaft and operates the hammer to produce both rotational and percussive force to a bit located on said hammer.

* * * * *